US006601331B2

(12) United States Patent
Salvitti

(10) Patent No.: US 6,601,331 B2
(45) Date of Patent: Aug. 5, 2003

(54) INTEGRATED MANUAL SAFETY DEVICE FOR HAMMERLESS SEMIAUTOMATIC PISTOLS

(76) Inventor: Alfred W. Salvitti, 3 Scottsdale Rd., Lansdowne, PA (US) 19050

( * ) Notice: Subject to any disclaimer, the term of this patent is extended or adjusted under 35 U.S.C. 154(b) by 0 days.

(21) Appl. No.: 09/833,290

(22) Filed: Apr. 12, 2001

(65) Prior Publication Data

US 2001/0037596 A1 Nov. 8, 2001

Related U.S. Application Data

(60) Provisional application No. 60/196,645, filed on Apr. 12, 2000.

(51) Int. Cl.[7] ..... F41A 17/00
(52) U.S. Cl. ..... 42/70.08
(58) Field of Search ..... 42/70.01, 70.08

(56) References Cited

U.S. PATENT DOCUMENTS

| | | | | |
|---|---|---|---|---|
| 1,155,326 A | | 9/1915 | Stamm | 42/16 |
| 1,160,343 A | | 11/1915 | Tomaszewski | 42/70.01 |
| 2,484,977 A | | 10/1949 | Wilcox | 42/70.08 |
| 3,352,047 A | | 11/1967 | McDonnell | 42/70.01 |
| 3,750,531 A | | 8/1973 | Angell et al. | 42/70.08 |
| 4,306,487 A | | 12/1981 | Beretta | 42/70.08 |
| 4,852,286 A | | 8/1989 | Troncoso et al. | 42/70.07 |
| 5,906,066 A | | 5/1999 | Felk | 42/69.02 |
| 5,913,666 A | | 6/1999 | Perkins | 42/70.08 |
| 6,240,670 B1 | * | 6/2001 | Findlay | 42/70.08 |
| 6,357,155 B1 | | 3/2002 | Amadini | 42/70.08 |
| 6,389,728 B1 | * | 5/2002 | Lundy | 42/70.11 |
| 6,405,470 B1 | * | 6/2002 | Strahan | 42/70.08 |

FOREIGN PATENT DOCUMENTS

| | | | |
|---|---|---|---|
| DE | 0117157 | 4/1930 | 42/70.08 |
| FR | 00003083 | 6/1847 | 42/70.01 |

* cited by examiner

*Primary Examiner*—Michael J. Carone
*Assistant Examiner*—Denise J Buckley
(74) *Attorney, Agent, or Firm*—Robert B. Famiglio; Famiglio & Associates

(57) ABSTRACT

A firearm safety device for use with semiautomatic pistols and other firearms which use striker pins to activate a firing pin is disclosed. The invention uses apparatus which selectively blocks the travel or operation of the striker pin to place the firearm in a safe condition. The invention allows for the application of key lock systems to place the firearm in a safe condition and to prevent tampering by unauthorized individuals. In the operation, the safety blocking mechanism operates by preventing the striker from reaching its released position upon application of trigger pressure. The firearm is also caused to be placed in an out of battery condition when selected on and there is any attempt to pull the trigger on the firearm.

3 Claims, 8 Drawing Sheets

INTEGRATED MANUAL SAFETY DEVICE FOR HAMMERLESS SEMIAUTOMATIC PISTOLS

CROSS REFERENCES TO RELATED APPLICATIONS

This application claims the benefit of the filing date for the applicant's provisional application, Ser. No. 60/196,645 which was filed Apr. 12, 2000 by the applicant.

BACKGROUND OF THE INVENTION

1. Field of the Invention

This application relates to improved safety features for semi-automatic firearms with hammerless designs or which use striker pins to activate a firing pin. More particularly it concerns hand-held or guns of the type which do not have manual safety selectors and which use a striker type firing mechanism rather than a hammer strike firing mechanism.

2. Description of Related Art and the Class of Weapons to Which the Invention is Drawn It is well known by police, military and other users of semi-automatic handguns that their accidental discharge is a very serious problem. Accidental discharge, often with fatal results, occurs by someone handling a weapon which was "supposed" to be on safety or, alternatively, which had its magazine removed and was supposed to be empty. Accordingly, much attention has been given, by designers, manufacturers and others skilled in the art of manufacture and use of semi-automatic firearms, to their construction or adaptation so as to avoid or mitigate the danger of accidental or inadvertent firing. The present invention further addresses this problem and provides the art with unique improvements in firearm construction that accomplishes this desired result with a manual safety system which heretofore was not available.

The majority of semi-automatic pistols in use, including those used as side-arms by the armed forces of the United States of America, are of the essentially single action type in which a firing pin, typically impacted by a hammer, is cocked into firing position by recoil of a slide when the weapon is discharged by pull of the trigger.(See U.S. Pat. Nos. 984,519 and 4,754,689). Some of these weapons may be double action on loading of the first round, but single action thereafter for all rounds in the magazine, i.e., they are not double action only weapons.

Such single action pistols are notorious for accidental discharge and various embodiments have been devised to improve their safety. This has included modification of the sear mechanism to reduce potential for movement on dropping or other impact of the weapon (see U.S. Pat. No. 4,646,619) and disablement of the trigger upon removal of the magazine (see U.S. Pat. No. 4,420,899).

Double action type pistols are those in which the firing pin is not cocked by slide recoil, but wherein trigger movement both cocks and releases the firing pin for weapon discharge (see U.S. Pat. No. 3,857,325). Since such pistols are not "armed" until trigger pull, they have less potential for accidental discharge upon being dropped or impacted. Still, accidental discharge is possible in such firearms and embodiments of them have been created to improve their safety, e.g., disablement of the trigger upon removal of the magazine (see U.S. Pat. No. 4,031,648). The present invention improves upon the inherent safety features of double action type firearms by provision of improvements thereto that virtually eliminate the possibility of their accidental discharge by dropping or impact or because there was a cartridge in the chamber of a gun from which the magazine had been removed.

OBJECTS OF THE INVENTION

A principal object of the present invention is the provision of new improved safety features for semi-automatic firearms which use a striker pin type of firing mechanism.

Further objects of the invention include an improved:

1. Manual safety device for hammerless pistols or other semi-automatic hand-guns guns wherein a firing pin is both cocked and released for firing by a trigger mechanism in contrast to the predominate type of semi-automatic guns in which a firing pin or related hammer is cocked by the recoil of the gun.
2. Manual safety lock mechanism for semi-automatic hand-guns having triggers, sears and firing pins that operate with relatively low and more constant friction as compared with prior known hand-guns.
3. Manual safety for such hand-guns that does not interfere with a constant, smooth trigger pull.
4. Manual safety in semiautomatic handguns in which the striker pin is positively blocked and/or prevented from reaching a fully retracted position necessary for the release of the pin and the firing of the weapon.
5. Manual safety in semiautomatic hand-guns in which attempted operation of the hand gun while the manual safety is engaged causes the gun to enter an out of battery condition, thereby preventing the firearm from operating.
6. Manual safety in semi-automatic handguns which provides an indication of the guns safe or ready-to-fire condition.

Other objects and further scope of applicability of the present invention will become apparent from the detailed descriptions given herein. It should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

A manual safety lock that allows positive manual lock-out of semiautomatic to hand-guns of hammerless design is disclosed. In hand-guns similar to the Glock and Smith & Wesson 99 style pistols which use hammerless firing mechanisms, frequently there are no manual safety lock-outs to provide for a positive disengagement of the striker pin used to strike the primer of a cartridge. The present invention provides a method for easily retrofitting existing hand-guns with a positive safety mechanism that can be manually selectable or can include the provision of a conventional lock pin screw device requiring a unique key type mechanism to unlock.

Although the present invention has been designed specifically to work with Glock brand pistols, and have been successfully operated in a prototype design, it is clear from the diagrams and consideration of similarly designed semi-automatic pistols that the invention should operate properly on all such similar striker pin hand-gun designs. Therefore, the description below will specifically reference a Glock hand-gun though it will be appreciated by those skilled in the art that the same mechanisms are frequently found on many other popular hand-guns using similar technology for striker pin design.

In the case of the Glock hand-guns, once fully assembled, the Glock has three safeties engaged. However, the safeties are not manually selectable and are meant simply to prevent the inadvertent movement of the striker pin, so that the firing pin operated by the striker mechanism cannot reach a primer on live ammunition without the trigger actually and deliberately being pulled. Such a system does not provide for a manual safety system which can be positively engaged by an operator to prevent firing of the pistol even if the trigger is inadvertently pulled by the operator or some other person. When the trigger is pressed on the Glock pistol and begins to move, the trigger safety of the Glock is disengaged. As the trigger safety is pressed flush with the face of the trigger, the rear-end of the safety retracts into, and flush with, the upper rear portion of the trigger. This allows the Glock trigger safety to clear the receiver as the trigger is moved to the rear. The vertically extending tab on the trigger bar pressing the firing pin safety upward disengages it. At this point, the ammunition primer of the pistol cartridge is now available for the firing pin to detonate. Thereafter, the trigger bar moves the firing pin to the rear as the trigger is pulled further back—this rear-end movement partially compressing the firing pin spring which ultimately provides the energy from moving the firing pin forward upon release. It is at this point that the present invention would operate to prevent further movement. When the tab of the trigger bar contacts the connectors angled lip, the Glock pistol is said to be cocked. Unlike conventional pistols which will remain cocked without trigger presser, Glocks will uncock themselves automatically if, at this point, trigger pressure is removed by the operator. At this point in the trigger operation, the firing pins spring of the Glock has been compressed roughly an additional ⅛ inch.

As the trigger on the Glock moves further to the rear, the trigger bar is forced to move downward as trigger pressure moves it further to the rear. This downward movement of the trigger bar caused the sear plate, the interval rear portion of the trigger bar, to move downward as well. The present invention serves to prevent the Glock from reaching this ready to fire condition. Upon further application of trigger pressure, the firing pin is released and driven forward by the compressed firing pins spring when the trigger has been pulled enough to move the trigger bar back far enough to slide down the connectors angled lip sufficient to drop the sear plate below the downward extension of the firing pin tang. Once released, the firing pin travels forward through the tunnel in the rear portion of the slide. The firing pins tip protrudes through the opening in the breach face and strikes the chambered primer thereby discharging the round.

The present invention, in its simplest form, provides a screw mechanism which mates with a threaded rear plate on the Glock where such threaded insert is located directly behind the striker pin, also referred to as the firing pin, preventing rearward movement of the striker pin—thereby preventing any firing of the Glock pistol unless and until such manual safety is moved or unthreaded. It can be appreciated that instead of using a simple manual twist mechanism for the screw-in safety device, a small locking mechanism can be used allowing locking of the safety on the "On" position until a key like mechanism, pin or other type of device, is inserted in the mechanism to release the blocking pin safety.

Various additional embodiments are disclosed with the present invention showing a button-like latching mechanism to allow the depression of the safety to come into contact with the rear of the firing pin to prevent firing in the same fashion as the simple twist-in safety which is first described below. Key-like mechanisms are also disclosed which utilize the same principle of blocking the movement of the striker pin to prevent firing and to render the pistol in a safe condition until the safety is removed using a key-like mechanism as disclosed. Finally, an improvement embodiment which utilizes a thumb slide safety which activates a latching piece which captures an extension of the striker pin to hold it in place until the unlatching of the slide safety mechanism. This last embodiment would require a replacement striker pin such that an extension of the pin shaft exists to mate with the extension capture mechanism disclosed. The present invention contemplates utilizing a modified striker pin which would be a direct replacement for the pistol without a requirement of altering the pistol or using a gunsmith to modify the firearm.

Therefore, in accordance with the disclosure, the present invention teaches an improved safety for any firearms utilizing a striker pin style of firing mechanism. The safety mechanism disclosed provides both a method of placing the firearm in a safe condition, and the means for accomplishing a safe condition. The method disclosed places a firearm of the type referenced in a safe condition by arresting the travel of the striker pin, which operates as the firearms firing pin, by selectively limiting the movement of the striker pin about its major axis. The method includes placing a selectively removable stopping mechanism substantially coaxial with the longitudinal axis or major axis of said firing pin or striker pin. Disclosed is also various embodiments discussed above, which, in all cases, provide a safety mechanism which include means for arresting the movement of the striker pin, and a firing pin integrated or operated by such striker pin selectively to prevent the striker pin from firing a cartridge upon attempted activation of the trigger. The selective activation means disclosed also provides a variety of different alternatives for capturing the movement of the striker pin in the types of firearms considered. Such means include conventional selecting means such as slide buttons and key locks, or ratcheting button type devices, all of which serve to capture the end of the striker pin of the firearm which is closest to the rear of the firearm.

The capturing or arresting means disclosed positions the safety blocking mechanism such as to prevent movement of the striker pin, or alternatively, to actually displace the striker pin by placing pressure against it when the safety blocking mechanism is activated. In such cases, additional pressure placed by the safety shaft blocking mechanism or other means used to displace the striker pin will cause the firearm slide to begin to move rearward, thereby taking the firearm into what is commonly known as an out of battery condition. Once placed in such a condition, most, if not all firearms, are designed not to allow operation of the firearm, thereby presenting a second level of safe operation.

Finally, disclosed is an alternative design which utilizes a field replaceable striker pin which has an extended tail which protrudes to the rear of the firearm allowing alternative capture means to arrest or control the striker pins movement. The alternative allows slide switch activation means to capture and hold the firing mechanism.

BRIEF DESCRIPTION OF THE VARIOUS DRAWINGS

DETAILED DESCRIPTION OF THE VARIOUS EMBODIMENTS

Figure 1:
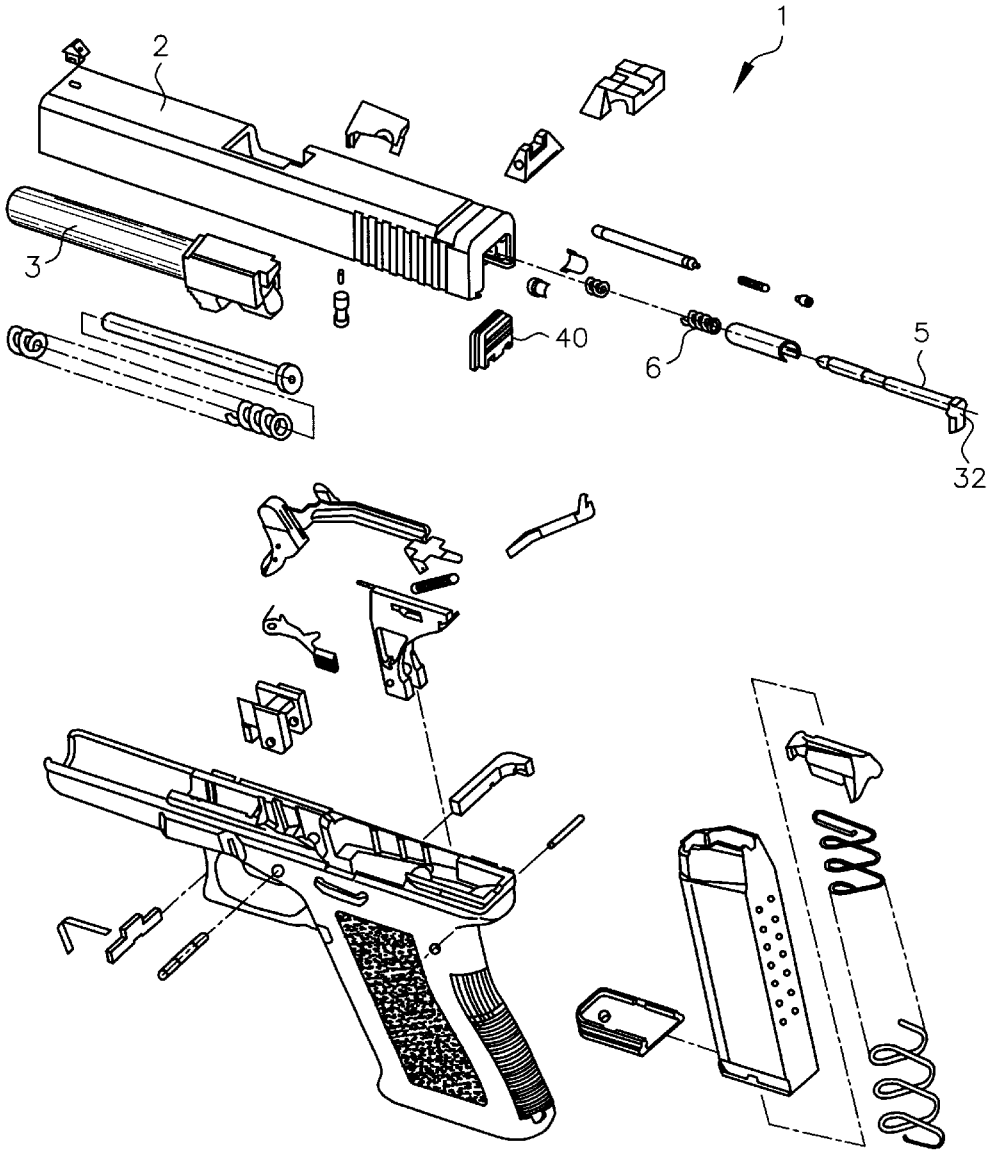
FIG. 1 is a partially ghosted view of a typical semiautomatic hand-gun which utilizes a striking pin mechanism for firing, showing the safety device installed.

The invention will now be described with specific reference to the various figures wherein like numbers represent like parts. FIG. 1 shows an exploded view of a Glock-style semiautomatic hand-gun comprised of its various operating parts. FIG. 1 will seem familiar to those skilled in the art as it discloses parts of a semiautomatic hand-gun which are similar regardless of the manufacturer of the firearm. Though Glock firearms are the most popular in this category, other hammerless hand-guns which utilize a striker mechanism are presently popular on the market. The invention will function well with such other firearms.

FIG. 1 illustrates pistol slide 2, which houses the striker pin 5 and striker pin firing spring 6. The thrust of the operation of the slide and the pistol disclosed in FIG. 1 is well known to those skilled in the art. Upon pulling the trigger, the firearm fires, moving slide 2 rearward, thereby ejecting the spent cartridge and going through a process which loads a new cartridge from the magazine and returns the weapon into an "in battery" condition. In this condition, the hand-gun is ready to fire again by the pull of the trigger. Glock-style pistols do not have manual safety locks, and, therefore, the weapon will fire as long as there is a cartridge in the chamber of the firearm and the trigger is pulled. A firing pin which strikes the primer on a cartridge loaded within pistol barrel 3 is activated by striker pin 5. Striker pin 5 is retracted rearward, compressing the striker pin firing spring 6, such that as when the trigger is depressed fully, the striker pin is released and the energy in the firing spring directs the striker to strike a firing pin which contacts the pistol primer, thereby firing the gun. The key to the present invention is arresting the action of striker pin 5 such that attempting to operate the hand-gun with the trigger against the safety device does not allow the pistol to fire, and even causes the hand-gun to be placed in an "out of battery" condition, which adds to the safety effect of the invention.

Figure 2:
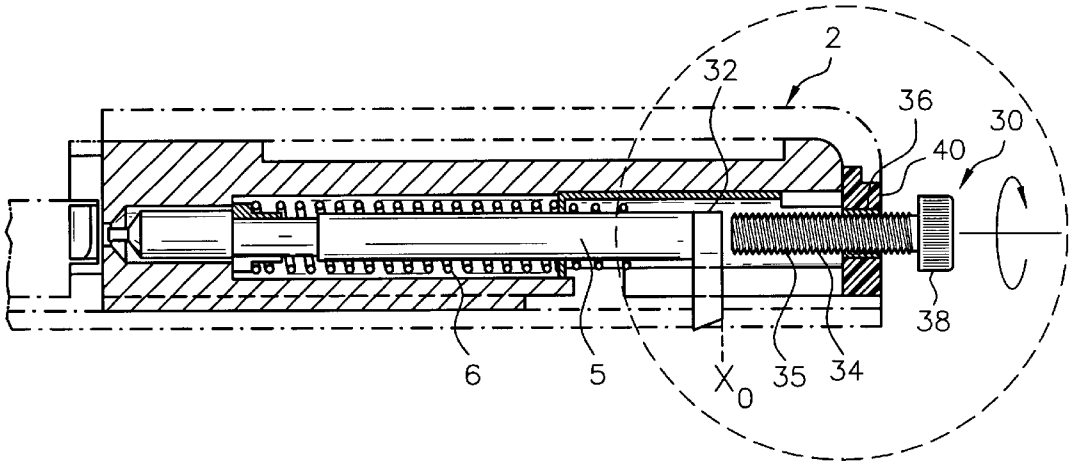
FIG. 2 is a cut-away view of a typical semiautomatic hand-gun slide showing first embodiment of the invention comprised of a firing pin striker blocking device for the invention in its simplest form.
Figure 4:
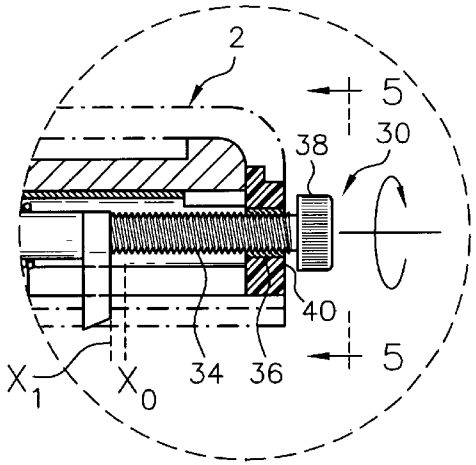
FIG. 4 is an expanded cut-away view of the blocker mechanism in contact with the rear of the firing pin striker mechanism, further illustrating the movement of the parameters of the safety.

Turning to FIG. 2, a cut-away view of a typical striker pin mechanism within the pistol slide 2 is disclosed. Spring mechanism 6 and striker pin 5, when activate by a trigger is pushed rearward, such as to compress spring 6 ultimately to be released when it reaches a release point because of the design of the mechanism. Once again, striker pin 5 would slide forward at such point, striking the primer on a chambered cartridge thereby firing the pistol.

The essence of the present invention is safety device 30 illustrated in one embodiment in FIG. 1 through FIG. 4 inclusive. Safety 30 is comprised of the knurled safety knob 38, the safety shaft 34, and safety shaft threads 35. Safety 30 is threaded through slide 2 rear cover plate 40. Threads 36, in the rear body of slide 2, provide the engagement means to allow the safety to be affixed to the rear of slide 2, and rotate about the axis of shaft 34 so that it may come into contact with the rear of striker pin 5, which is striker pin head 32.

By blocking the travel of striker pin 5 through contact with safety shaft 34, the striker pin cannot travel rearward enough to reach a pre-designed release point inherent in the design of the pistol. Additional pressure on the trigger in an attempt to overcome the blocking action of safety 30, will simply cause the slide to move rearward as the safety transmits the striker pin's rearward force into slide 2.

Figure 3:
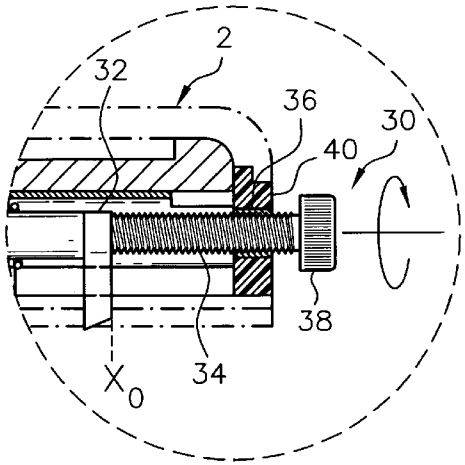
FIG. 3 is an expanded, cut-away view illustrating the firing pin striker blocking mechanism in the engaged position.

FIG. 3 illustrates the contact of striker pin head 32 with safety shaft 34. As can be appreciated, when rearward force is applied to striker pin through the additional pressure on the trigger, safety 30 blocks the travel of the striker thereby rendering the firearm in a safe condition. Knob 38 is turned by the operator of the pistol to render the pistol in a safe condition, or a firing condition by turning the safety in the reverse direction to retract shaft 34 from contact with striker pin head 32.

Figure 5:
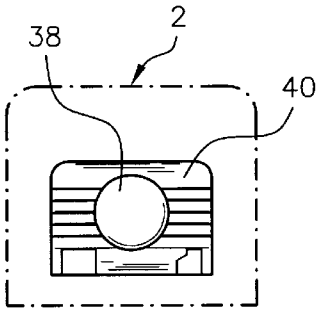
FIG. 5 is an the rear view of the slide mechanism illustrated in FIGS. 2, 3, and 4, showing a view of knurled knob blocking mechanism.

FIG. 5 is a rear view of slide 2 showing the appearance and size of the knob 38 which activates the pistol safety device in its simplest form.

Figure 6:
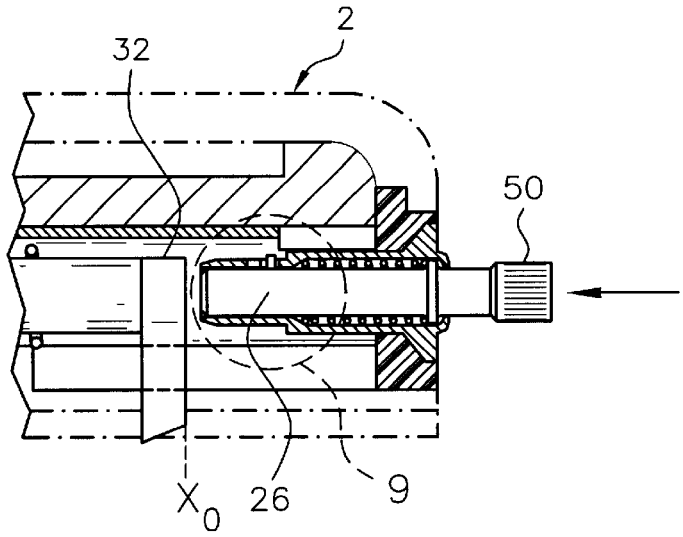
FIG. 6 is a cut-away view of another embodiment of the invention illustrating the firing pin striker blocking device which is engaged with a push button ratcheting mechanism.
Figure 7:
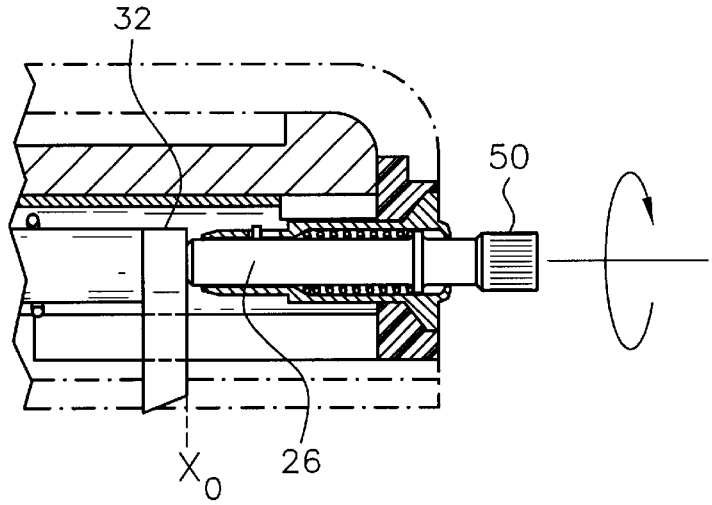
FIG. 7 is a cut-away view illustrating a variation of the firing pin's blocking mechanism of FIG. 6 shown in the engaged position.
Figure 8:
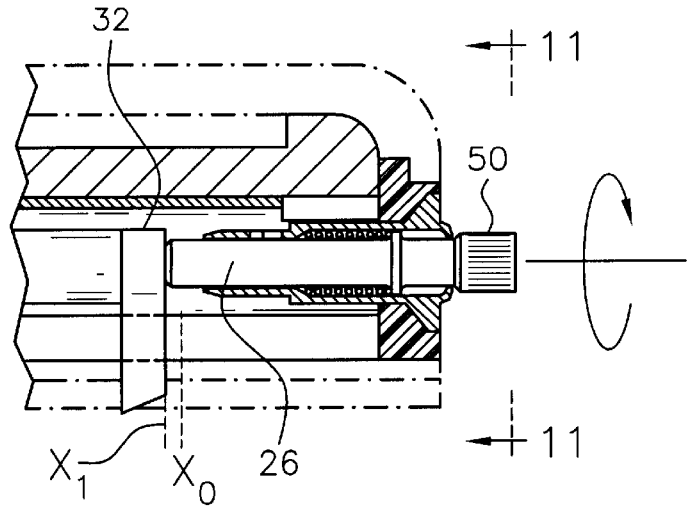
FIG. 8 is a cut-away view of the alternate embodiment of the firing pin blocking pin mechanism illustrating the displacement of the firing pin striker when trigger force is applied and there is force transmitted through the striker to the blocking mechanism.
Figure 9:
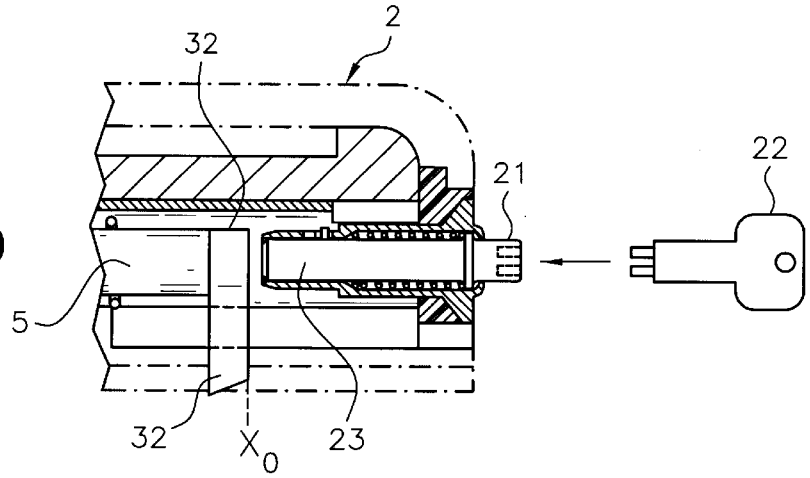
FIG. 9 is another embodiment of the present invention illustrating a firing pin striker blocking mechanism which is engaged through the use of a key mechanism to prevent tampering.
Figure 10:
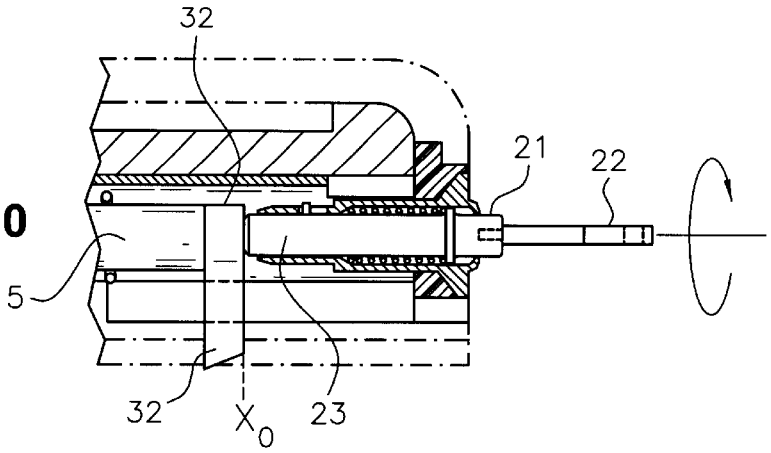
FIG. 10 is a cut-away view of the alternative blocking mechanism displayed in FIG. 9 illustrating the engagement of the blocking mechanism against the striker mechanism.
Figure 11:
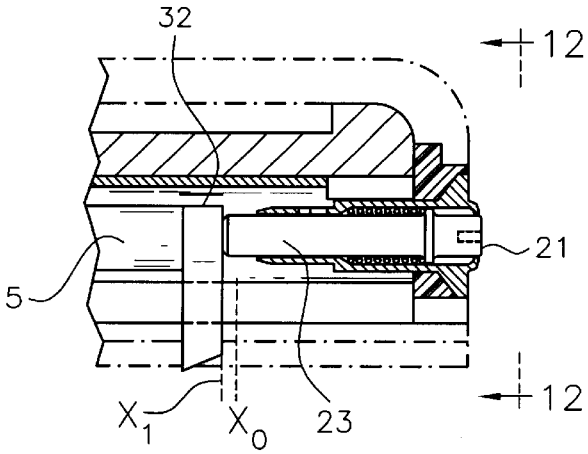
FIG. 11 is a cut-away view shown in FIG. 10 illustrating further the displacement of the striker mechanism under a trigger force load.

Turning to FIG. 6 through FIG. 8, a variation of the striker pin safety device is shown utilizing a pre-set latching device designed to either be in a fully off or fully on position. Rather than adjust the safety by turning a threaded shaft to create a contact between the safety device and the striker pin, the preferred embodiment utilizes a pre-designed safety device which is ratcheted in a fashion to allow the depth of travel for contact to be pre-determined. Safety 50 in the embodiment shown, allows contact of the safety shaft at a pre-determined location without adjustment of the dial for the knob used on the simplest form of the safety device disclosed.

In FIGS. 6 through 8, it can be seen that safety shaft 26 contacts striker pin head 32 as described in the first embodiment and in the same fashion. Continued pressure on the trigger, attempting to force the striker pin rearward, causes the striker pin head 32 to continue placing pressure on shaft 26, forcing the firearm slide to be displaced rearward taking the firearm out of battery. This is depicted in the various figures by the displacement shown at $x_0$ and $x_1$ when the slide is displaced upon the application of pressure through contact between the striker pin head and the safety shaft blocking its movement. If the shaft 26 is placed such as to contact the striker pin head 32 and then continued movement of the shaft 34 occurs, there will be a displacement of slide illustrated by $x_0$ and $x_1$ in the various drawings. The optimal displacement of the slide 2, in this process is about 1/16 of an inch, as illustrated. This is an important option in the setting of the safe condition taught in the present invention in that it causes an out of battery condition which itself will prevent the firearm from operating if the trigger is operated, even with great force.

FIG. 7 shows the safety 50 in contact with the rear of the striker, where FIG. 6 is in the firing position as the safety is retracted. It is contemplated that safety 12 would be compromised of a snap-in device much like the action of a retractable pen utilizing a push button to select between two positions of the shaft. In this embodiment, adjustments of the safety for the discretion of the firearm owner can be accomplished by having vernier adjustments in the ratcheting device such that a circular motion can set the relative positions of the safety on and safety off location of the safety shaft.

FIG. 8, illustrating a variation of the striker pin safety device shown in FIG. 6 and FIG. 7, describes the movement of the striker pin head 32 upon the application of pressure on the trigger. As can be appreciated by considering the location of the contact between head 32 and the contact point of the safety 50, movement of the contact point occurs relative to upper slide 2. When pressure is applied on the trigger when pistol 1 is in the safe mode using the present invention, continued attempt to apply pressure on the trigger to fire the gun will move the entire slide assembly 2 thereby taking the pistol into an "out of battery" condition and will prevent firing of the firearm.

Yet another variation of the invention is described in FIGS. 9 through 12, showing a variation which provides for a locking device 21, attached to locking shaft 23 of the disclosed embodiment. It can be appreciated that the function of the safety lock, in blocking the striker firing pin 5, is similar to the embodiments which were previously described and illustrated. In the embodiment of the safety device which uses a locking key 22, it can be appreciated that the key lock 21 activates the camming mechanism or other device which allows the movement of shaft 23 in the safe and unsafe position. With the device as illustrated in the embodiment, the safety mechanism can also be used as a locking mechanism to prevent use of the firearm without the insertion of key 22 which would mate with keylock 21 on the head of the shaft 23.

Figure 12:
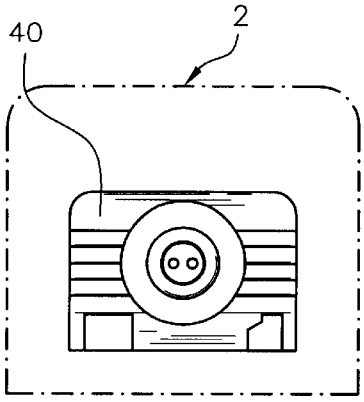
FIG. 12 is an end view of the alternate safety lock mechanism shown in FIGS. 9 through 11, viewed from the end of the upper slide of the firearm.
Figure 13:
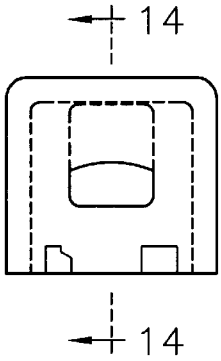
FIG. 13 is a view of an improved sliding latch mechanism shown from the rear of the upper slide of the firearm.
Figure 14:
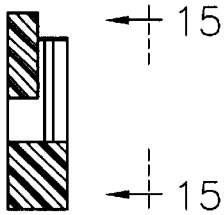
FIG. 14 is a sectional side view of the sliding latch mechanism for the striker pin catch mechanism.
Figure 15:
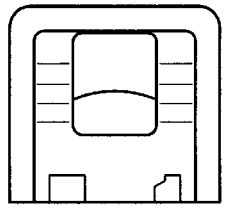
FIG. 15 is a rear view of the striker latching mechanism.
Figure 16:
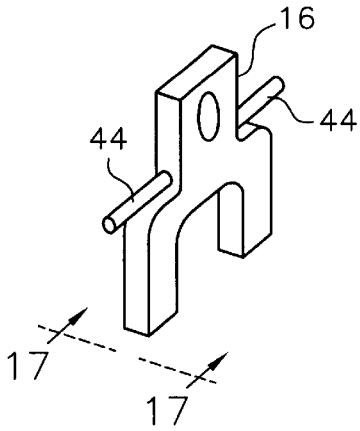
FIG. 16 is an illustration of the improved striker pin latching mechanism designed to capture a head piece on the rear of the striker mechanism to prevent movement.
Figure 17:
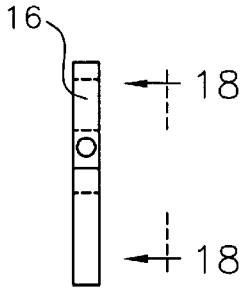
FIG. 17 is an edge view of striker catch shown in FIG. 16.
Figure 18:
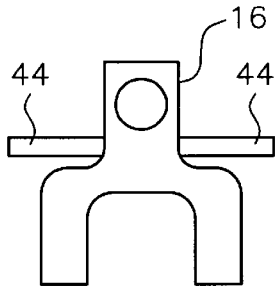
FIG. 18 is a plan view of the striker catch mechanism used in an alternative embodiment of the present invention.
Figure 19:
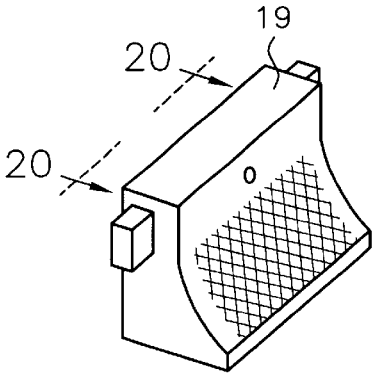
FIG. 19 is a perspective view of the slide button mechanism used to activate the striker pin capture piece shown in FIGS. 16 through 18.
Figure 20:
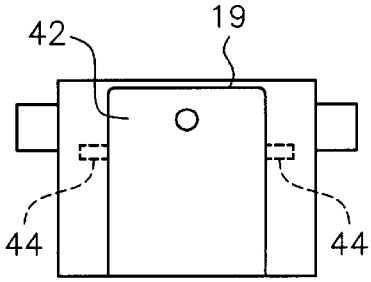
FIG. 20 is a plan view of the rear of the slide button activation device shown in FIG. 19.
Figure 21:
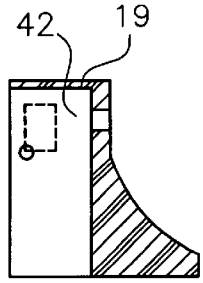
FIG. 21 is a sectional view of the slide button activation mechanism shown in FIG. 19.

FIG. 12 illustrates a rear view of the pistol slide 2, showing the relative size of key lock 21 as it is viewed with the key removed. It is contemplated that the firearm, when in normal use and with the key lock in the "fire" position, with safety devices relatively unobtrusive and should not interfere with the operation of the firearm.

In reviewing the history of safety devices used to place a firearm or handgun in a safe, rather than a fire mode, it would be observed that many firearms use slide levers, buttons, or tabs to manually select a fire or safe condition. An alteration of the safety described provides for a tab lock or a sliding button which may be preferred by some users of the firearm in which the operation of a slide switch may be preferred as a safety device.

Figure 22:
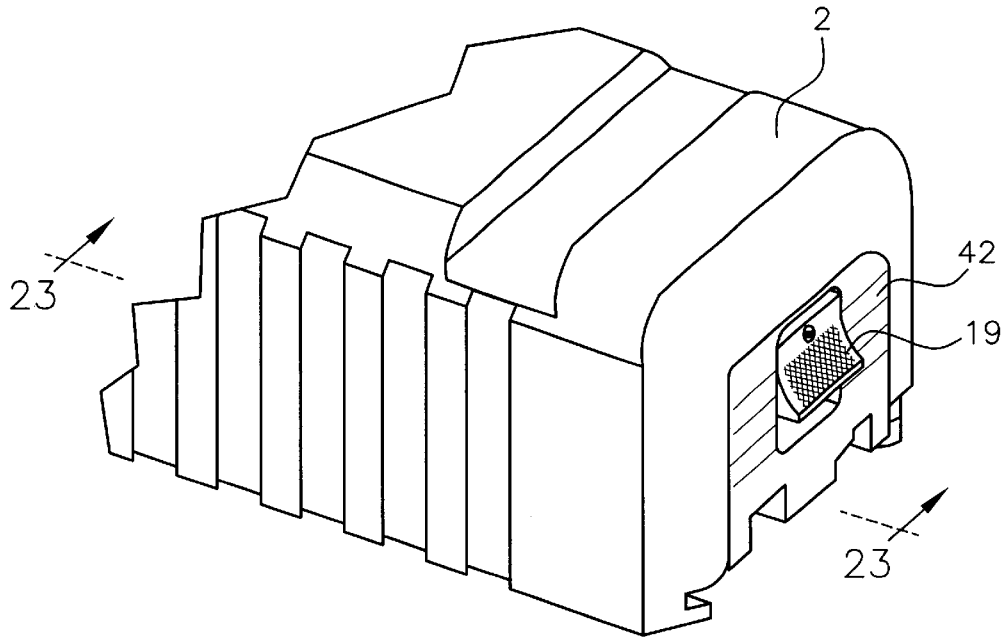
FIG. 22 is a perspective view of the assembled striker pin capture mechanism shown in place on the rear of a typical upper slide of a Glock firearm.
Figure 23:
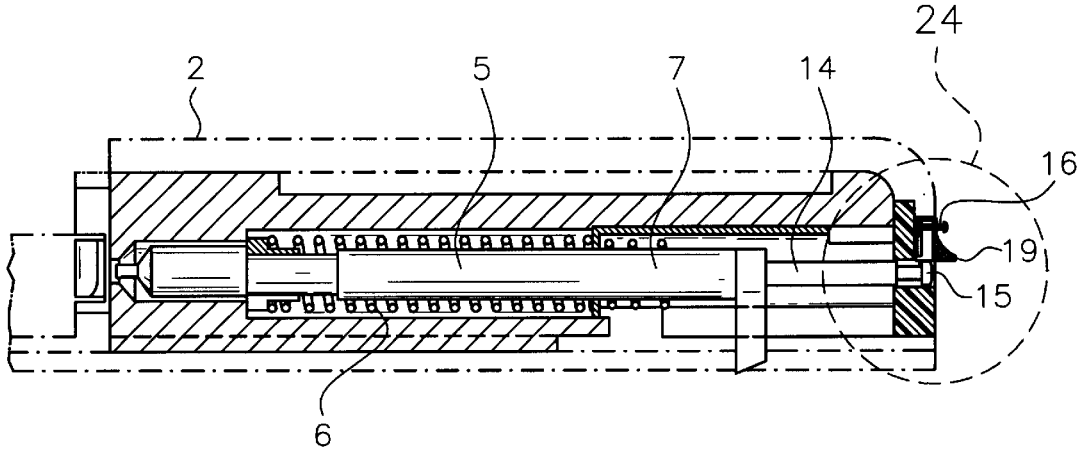
FIG. 23 is a cut-away view of a typical upper slide mechanism of a firearm showing the striker pin extension that is captured by the slide mechanism illustrated in FIGS. 19 through 22.
Figure 24:
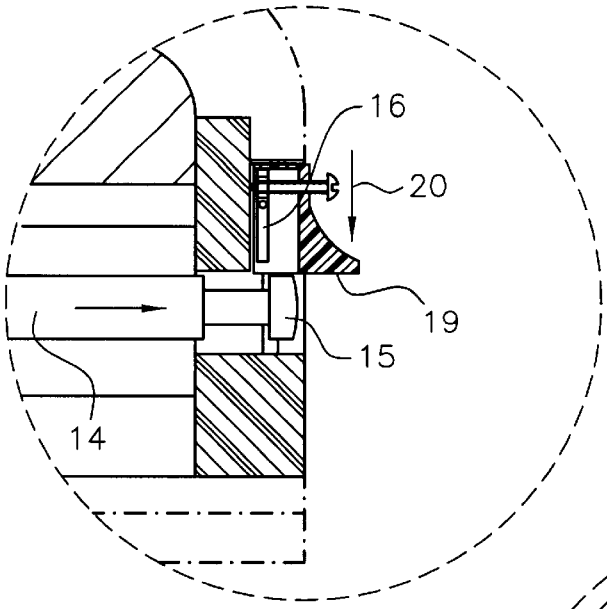
FIG. 24 is an enlargement of an alternate embodiment of the present invention showing the striker capture piece as shown in FIG. 16 through FIG. 18 assembled within the slide button mechanism in FIG. 19 in the safe position.

FIG. 22 illustrates the rear end of slide 5 showing a variation of the present invention using slide safety button 19 which is attached and protrudes through slide rear cover plate 42. As can be seen in FIG. 23, a cutaway view of pistol slide 2, this last described embodiment operates in a similar fashion, but requires the use of a modified striker assembly 7. Assembly 7 is a combination of the striker pin 5, along with a striker pin extension 14 shown in FIG. 23. As can be appreciated, this assembly may be a "drop in" modification allowing those firearm owners wishing to employ the present invention to utilize it by applying the devices necessary without modifying the basic firearm and allowing the firearm to be restored to its original condition. This may be an important consideration for certain owners of firearms that do not wish to engage in modification of a frame, or have a gunsmith cut or drill an existing firearm. As can be seen in FIG. 23, striker pin extension 14 has a striker extension head 15 which is captured by the application of a latch clip 16 sliding down over head 15 to prevent movement of the striker assembly 7 when the present embodiment is in a safe mode. Slide safety button 19 is shown more clearly in considering FIG. 24 showing the safety in a firing mode. As can be appreciated to those familiar with the operation of a conventional striker pin firearm, striker pin extension 14 will move in a rearward direction when pistol I is in a cocked mode, ready to fire. In fact, when button 19 is in the up position, or a ready to fire position, the operator of the firearm can see that striker extension head 15 is visible on the rear of the pistol slide 5, confirming that the pistol is cocked and ready to fire. Squeezing pistol I trigger to fire the firearm will cause the striker assembly 7, and therefore, the striker extension head 15 to move further to the rear before being released and firing the firearm.

Figure 25:
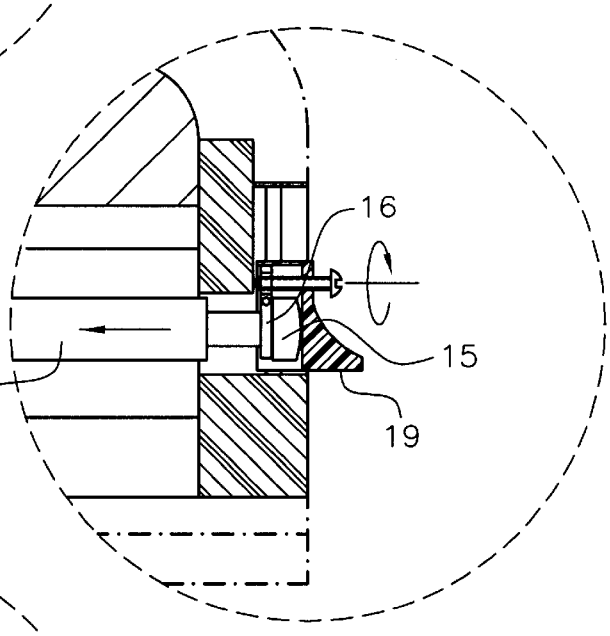
FIG. 25 is the alternate embodiment of the present invention shown in the fully safe position with the striker mechanism capture piece engaging the striker.

In considering FIG. 25, this cutaway view of the present embodiment illustrates the safe mode of this version of the firearm safety device which captures striker extension head 15 and will not allow the striker assembly 7, and ultimately striker pin 5 to activate pistol 1 if an attempt is made to squeeze the trigger.

An advantage of the slide safety button embodiment herein described is that striker extension head 15 can be fashioned to be visible from the rear of the firearm as a status indicator of the position of the striker pin 14. If striker extension head 15 is fashioned out of a brightly colored or flourescent material or paint, as the striker moves rearward under movement by activation of the trigger, extension head 15 will protrude beyond the rear of the firearm such that the user will be able to determine whether the striker is in a half cock position, or is fully forward.

When the firearm is in the safe mode shown in FIG. 25, it is possible that a release of the safety by the application of upward pressure on slide safety button 19 may cause striker assembly 7 to slip forward, slightly, and possibly threaten to discharge the firearm in certain situations. Although it is contemplated that this is an unlikely event, to enhance the safety of the present device, it has been determined that requiring the activation and operation of slide 2 for pistol 1 before button 19 can be slid upward in a ready to fire condition, can eliminate the danger of the firearm inadvertently being fired upon the release of button 19. To enhance the safety of the present device, striker extension latch clip 16 is utilized to block the operation of the slide safety button 19 until slide 2 is operated in the rear direction releasing any tension on striker assembly 7.

Figure 26:
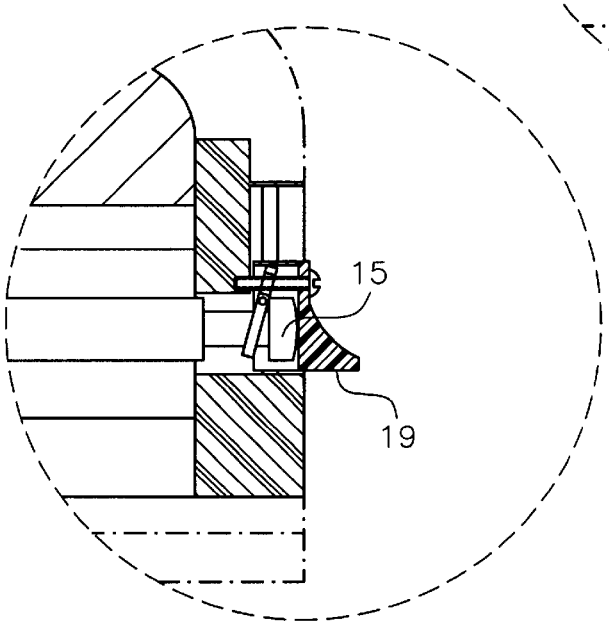
FIG. 26 is a cut-away view illustrating a captured firing pin striker attempting to move forward under activation of the trigger while in the safe position.
Figure 27:
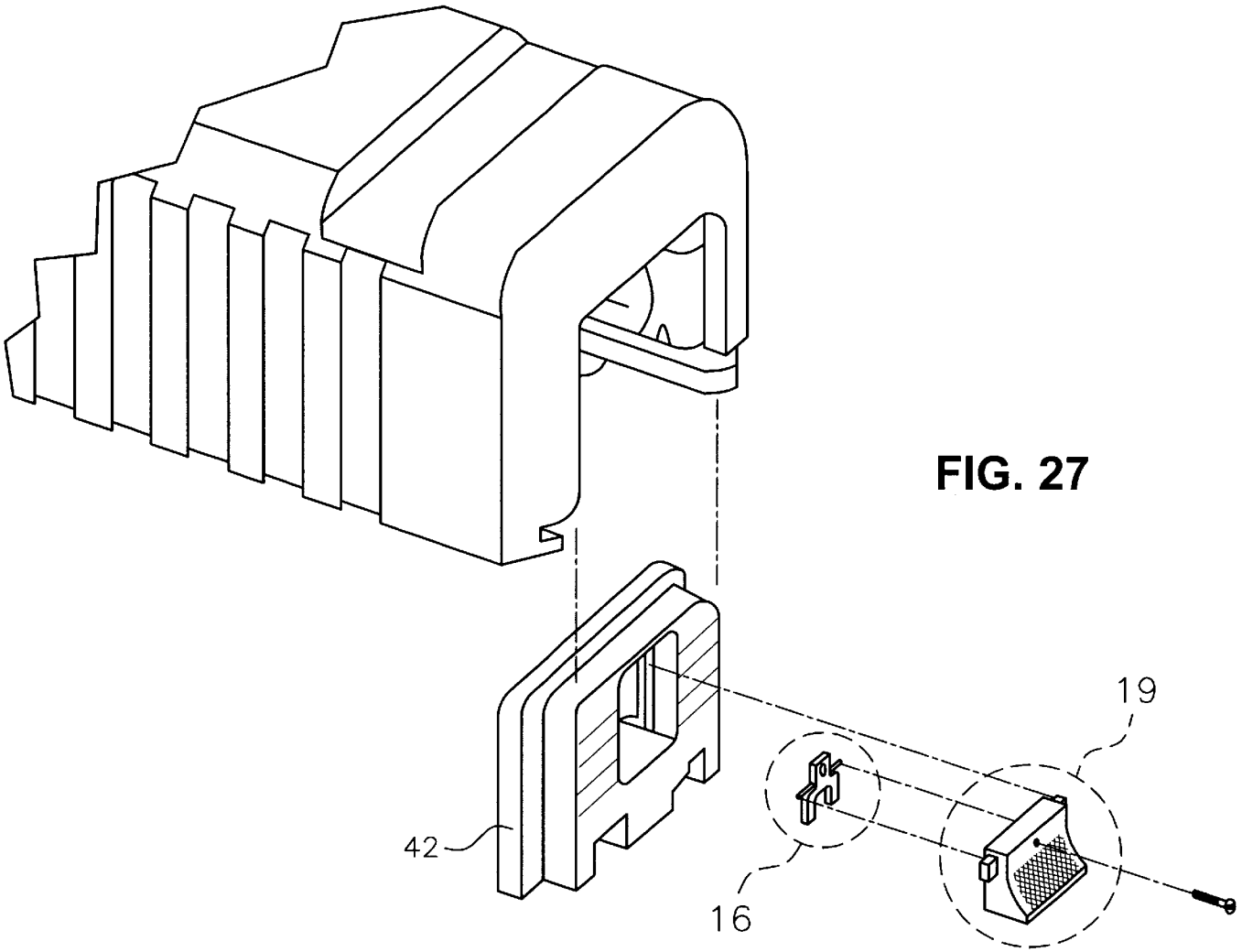
FIG. 27 is an exploded view of a typical upper slide to a Glock firearm showing the relative size and position of the firing pin capture mechanism in the slide button safety embodiment of the present invention.

As can be appreciated by considering the difference in the operating position of latch 16 shown in FIG. 25, and then in FIG. 26, the rotation of latch 16 about latch clip axil 44 causes the latch clip 16 to translate from a totally vertical condition as shown in FIG. 25, to a slightly angled position shown in FIG. 26, thereby binding and locking down safety button 19. The pulling forward of latch clip 16 causes the face of the latch to be out of its vertical track, and therefore binds the movement of Button 19 until the slide is cycled and put into a half-cock position.

FIG. 13 through FIG. 21 inclusive shows the shape and details of the various operating components used in this latest embodiment whereby latch clip 16 prevents operation of the safety into the off position until the recycling of the slide 2. Once in the safe condition, tension on the striker 14 causes latch clip 16 to pivot about axil 44 because of the force being applied to the clip by the striker spring 6. Clip 16 operates within the slide rear cover plate 42 which integrates with button 19 to slide vertically within tracks designed within cover plate 42 to accommodate button assembly which operates to capture striker extension head 15.

In considering this latest embodiment with the slide button safety operation, those skilled in the art will immediately recognize that the slide button mechanism for capturing the extended striker head could be fashioned such as to move side by side, or offset the button to one side, if preferred, using a mechanism to capture the striker which functions in the same way as that disclosed in the present invention.

It can be appreciated from the foregoing description and various embodiments provided that numerous changes or modifications may be made without the departing from the spirit or the scope of the invention as intended. Although certain preferred embodiments are presented for the purpose of describing the applications of the present invention either presently manufactured by the inventor or otherwise shown to satisfactorily operate, other such species or derivations from the thrust of the invention presented are considered within the scope of the invention.

What is claimed is:

1. A manual safety lock-out mechanism for a hammerless semi-automatic firearm that arrests the movement of a modified striker pin assembly to selectively prevent said striker pin assembly from firing a cartridge upon attempted activation of the trigger comprising:

a modified striker pin assembly that is a combination of a striker pin, striker pin extension and striker pin extension head, a slide safety which activates a latching piece that captures said striker pin extension head to prevent any axial movement of the entire striker pin assembly until the slide safety mechanism is unlatched.

2. The manual safety lock-out mechanism set forth in claim 1, wherein the head of said striker pin extension head can be constructed to be visible from the rear of the firearm as a status indicator of the position of the striker pin assembly.

3. The manual safety lock-out mechanism set forth in claim 1, wherein said latching piece is utilized to block the operation of said slide safety until the pistol slide is cycled and put into a half-cock position which releases any tension on the striker pin assembly.

* * * * *